US007789248B1

(12) United States Patent
Salerno et al.

(10) Patent No.: US 7,789,248 B1
(45) Date of Patent: Sep. 7, 2010

(54) HANGABLE GEAR HOLDER

(76) Inventors: Russell J. Salerno, 50 Cirrus Rd., Holbrook, NY (US) 11741; Charles E. Muller, 66 King St., Port Jefferson Station, NY (US) 11776

( * ) Notice: Subject to any disclaimer, the term of this patent is extended or adjusted under 35 U.S.C. 154(b) by 553 days.

(21) Appl. No.: 11/695,803

(22) Filed: Apr. 3, 2007

(51) Int. Cl.
*A47F 7/00* (2006.01)

(52) U.S. Cl. ..... 211/85.7; 211/106.01; 211/113; 211/87.01; 211/86.01; 248/215; 248/301

(58) Field of Classification Search ..... 211/85.7, 211/106.1, 113, 118, 70.5, 87.01, 86.01, 211/70.6, 26.2, 106; 248/215, 220.43, 301, 248/227.1, 322, 340, 307, 304
See application file for complete search history.

(56) References Cited

U.S. PATENT DOCUMENTS

| | | | | | |
|---|---|---|---|---|---|
| 24,862 | A * | 7/1859 | Odlum | 122/64 |
| 543,735 | A * | 7/1895 | House | 211/106.01 |
| 661,557 | A * | 11/1900 | Schwab | 52/27 |
| 850,576 | A * | 4/1907 | Hess | 211/65 |
| 2,842,264 | A * | 7/1958 | Larson | 206/526 |
| 4,193,495 | A * | 3/1980 | Keeley | 294/143 |
| 4,434,960 | A * | 3/1984 | Berry | 248/220.43 |
| 4,629,065 | A | 12/1986 | Braaten | |
| 5,337,907 | A | 8/1994 | McKenzie et al. | |
| 5,626,244 | A | 5/1997 | Mesna et al. | |
| 5,690,235 | A | 11/1997 | Matzen | |
| 5,836,460 | A | 11/1998 | Brown et al. | |
| 6,659,412 | B1 * | 12/2003 | Roach | 248/215 |
| 6,749,074 | B1 | 6/2004 | Hileman et al. | |
| 6,808,077 | B2 * | 10/2004 | McConnell | 211/70.6 |
| 7,077,275 | B2 * | 7/2006 | Kao | 211/70.6 |
| 7,198,158 | B2 * | 4/2007 | Kao | 211/70.6 |
| 7,320,452 | B2 * | 1/2008 | Chen | 248/227.1 |
| 2003/0062328 | A1 * | 4/2003 | Millard | 211/85.7 |
| 2004/0020880 | A1 * | 2/2004 | Kao | 211/70.6 |
| 2005/0194335 | A1 | 9/2005 | Hibner | |
| 2007/0007222 | A1 * | 1/2007 | Kao | 211/70.6 |

* cited by examiner

*Primary Examiner*—Darnell M Jayne
*Assistant Examiner*—Devin Barnett
(74) *Attorney, Agent, or Firm*—Island Patent; F. Scott Tierno

(57) ABSTRACT

A portable and hangable gear holding unit includes a main portion and a number of positionable gear holding members. Each gear holding member, which may include a hook, extended or orthogonal tab, clip, and or equivalents, is structured for engaging and holding at least one piece of gear above a ground surface. The hangable gear holding unit may be portable, and transported to a location for hanging upon a support structure, such as a partition or chain link fence, for subsequent use in holding gear.

15 Claims, 7 Drawing Sheets

HANGABLE GEAR HOLDER

TECHNICAL FIELD

The presently disclosed invention relates most generally to gear holding apparatus. More particularly, the present invention relates to a portable and or hangable gear holder having a plurality of gear holding members (e.g., hooks, extensions, horizontal tabs, clips, etc.).

BACKGROUND

Athletic fields, playgrounds, parks, schools, and like locations, often include significant grass and dirt areas. When conditions are particularly dry, say during extended periods of no rain, such locations can become quite dusty and dirty. Additionally, when rainy conditions prevail, these types of locations can become muddy, water laden, and often truly sloppy.

When considering locations such as baseball fields and soccer fields, to name a few, there is often a dearth of means available to hang sports equipment and other related items upon, in order to keep them off the ground surfaces. For example, consider a typical dugout location for a little league team. There is often a simple single wooden or metal bench provided. This approach, wherein minimal facilities are provided (other than the playing field), yields a rugged low maintenance arrangement, with structures that are somewhat vandal proof. However, when considering an entire baseball team, a simple bench is often far from enough space to securely support all team members, their bats, gloves, water bottles, etc. Many items end up on the ground. In addition to the obvious problems of contacting dirt, litter, etc., there is the possibly of gear being stepped upon and further soiled or damaged. Again, when it is a rainy day, the situation becomes considerably worse.

Accordingly, there is a need for improved and portable means that may be employed, possibly in a temporary and removable manner, for holding and securing a number of, or variety of gear, including work, sports, and athletic items. A number of other characteristics, advantages, and or associated novel features of the present invention, will become clear from the description and figures provided herein. Attention is called to the fact, however, that the drawings are illustrative only. In particular, the embodiments included and described, have been chosen in order to best explain the principles, features, and characteristics of the invention, and its practical application, to thereby enable skilled persons to best utilize the invention and a wide variety of embodiments providable that are based on these principles, features, and characteristics. Accordingly, all equivalent variations possible are contemplated as being part of the invention, limited only by the scope of the appended claims.

SUMMARY OF PREFERRED EMBODIMENTS

In accordance with the present invention, a portable and hangable gear holder, for example structured for use with sports gear, comprises a hangable structure, which may be fixed to an available nearby support structure. Once suitably placed upon, or coupled to the support structure, the gear holder may be employed for holding and securing any of a possible plurality and variety of gear, including sports gear, work gear, recreational gear, and or like items.

The hangable gear holder includes a main portion. The main portion, which may be provided by a somewhat simple plate structure, may be termed a 'main plate member', or equivalently a 'main plate portion', in certain preferred embodiments. Accordingly, the main portion is most preferably rigid and may be arranged having a first surface and a second surface, along with what may be termed an upper edge and a lower edge.

Further included are a plurality of gear holding members, which may include curved hook portions, various extensions, orthogonal tabs, clips, etc., and are structured for engaging and holding and securing at least one piece of gear. For example, for the specific embodiments illustrated the gear depicted is sports gear, and may include, but is certainly not limited to, items such as baseball mitts, bats, gloves, caps, helmets, water bottles, balls, and the like. Additionally, two gear holding members, in combination, may be employed, for example, to hold and secure a baseball bat. Although gear holding members may preferably be structured with a gear engaging end, a middle portion, and an end portion, which may all be preferably formed out of a length of a strip material or strip member. It should further be understood that other configurations and arrangements are certainly possible and contemplated as being within the scope of the invention.

When considering the possibly most preferred embodiments of the hangable gear holder of the present invention, an adjustment feature may be included. As will be discussed in a good deal of detail hereinafter, preferably a plurality of the gear holding members may be adjustably coupled to a main portion, such as the main plate member, say via a movable coupling structure. This adjustability feature includes a constraining arrangement for enabling an individual to place a gear holding member in one of a plurality of pre-defined fixing locations along a longitudinal axis of the main portion—and thereby may configure the hangable gear holder for holding gear of differing sizes and or structures. Although a number of structures may be employed for the constraining arrangement, an exemplary arrangement will be taught wherein at least one elongated rail member is included, in fixed spaced relationship to a rear surface of the main portion. Providable adjustable structures must enable a respective gear holding member to be slidably movable, and mechanically lockable in one of a plurality of available fixing locations. Once placed into a suitable fixing location, a gear holding member will be available for holding and securing at least one piece of gear. It should be understood that the terms 'securing' and 'secured' indicate that a piece of gear is held in such a fashion as to not be easily knocked or bumped off of the hangable gear holder of the invention. Accordingly, it should be assumed that there is intent, either explicit or implicit, to indicate that pieces of gear are secured is such a manner as prevent or reduce theft. That is, 'securing' does not imply or indicate security.

BRIEF DESCRIPTION OF THE DRAWINGS

In the drawings, like elements are assigned like reference numerals. The drawings are not necessarily to scale, with the emphasis instead placed upon the principles and features of the present invention. Additionally, each of the embodiments depicted are but one of a number of possible arrangements utilizing the fundamental concepts of the present invention. The drawings are briefly described as follows.

Partial List Of Reference Numerals

Figure 1:
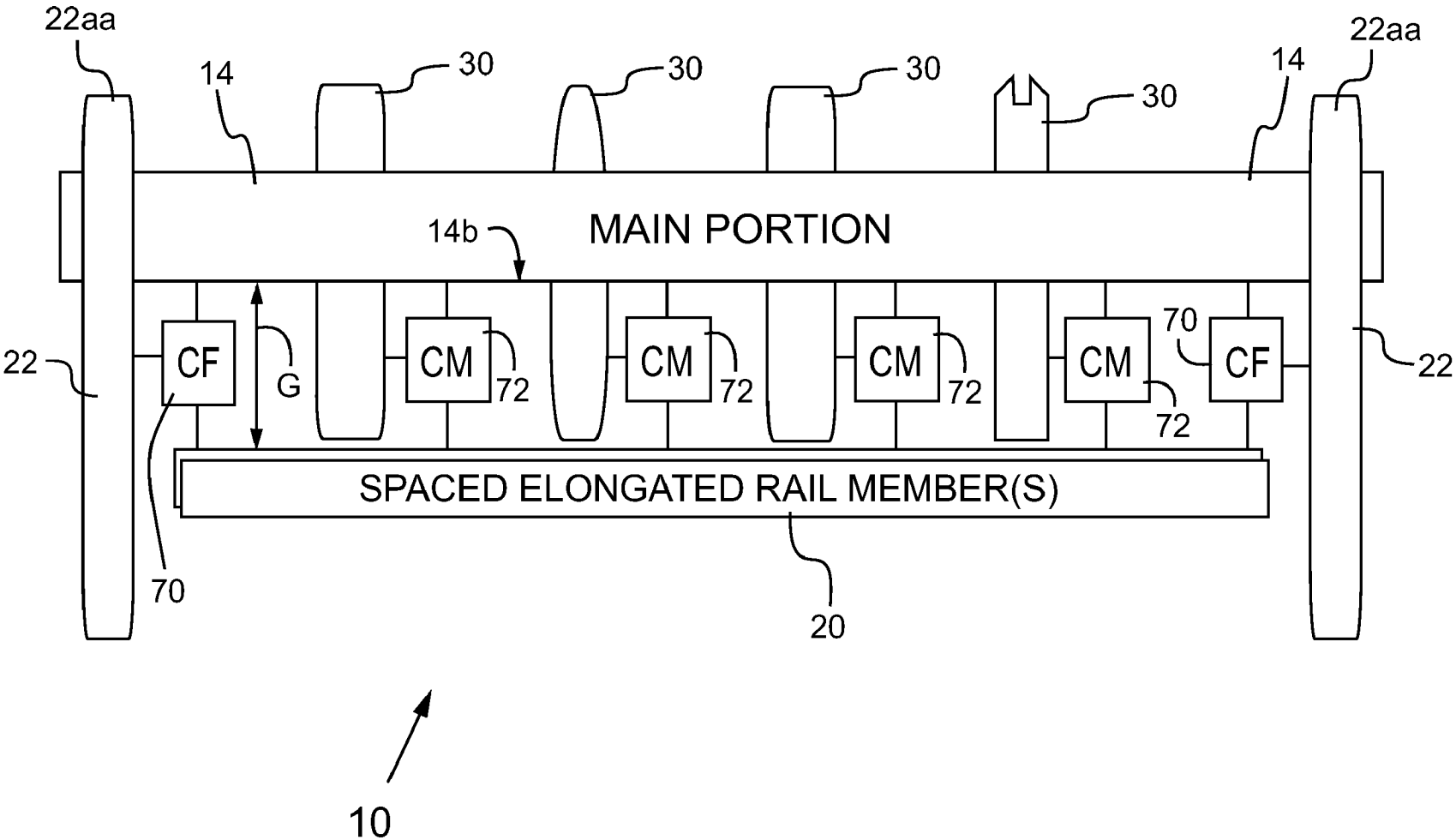
FIG. 1 depicts a high level generalized block diagram of an embodiment of a hangable gear holder in accordance with the present invention.

| | |
|---|---|
| 10, 10a, 10b | hangable gear holder |
| 14 | main portion |
| 14a | first surface (of 14) |
| 14b | second surface (of 14) |
| 14-1, 14-2 | main plate member |
| 14-1a | first surface (of 14-1) |
| 14-1b | second surface (of 14-1) |
| 16 | upper edge (of 14 or 14-1) |
| 18 | lower edge (of 14 or 14-1) |
| 20a | first elongated rail member |
| 20b | second elongated rail member |
| 22 | support structure engaging member |
| 22a | s-shaped double hook member |
| 22aa | support structure engaging hook portion |
| 22bb | gear holding hook portion (fixed) |
| 26 | spacer |
| 28 | notch |
| 30 | gear holding member |
| 30a | movable hook member |
| 30aa | hook portion (of 30a) |
| 30ab | middle (linear) portion (of 30a) |
| 30ac | end portion (of 30a) |
| 30b | bottom supporting tab member |
| 30bb | extended bottom tab (of 30b) |
| 32 | notch engaging projection (projection) |
| 34a | elastic loop |
| 34b | adjustable loop |
| 40 | fastener |
| 44 | longitudinal slot |
| 46 | graphic |
| 60 | carry cutout |
| 62, 62a | carry handle |
| 68 | graphic (logo, etc.) |
| 70 | fixed coupling |
| 72 | movable coupling (slidable and fixable) |
| 82 | baseball bat |
| 83 | baseball helmet |
| 84 | baseball mitt |
| 85 | bag of baseballs |
| 86 | drink bottle |
| 87 | sack of water bottles |
| G | gap (=gear holding member thickness) |
| L | longitudinal axis |

DETAILED DESCRIPTION OF EMBODIMENTS OF THE INVENTION

It is important to establish the definition of a number of descriptive terms and expressions that will be used throughout this disclosure. The term 'gear', which may be assumed to be any gear associated with athletic, recreational, hobby, and or work related activities, and any needed support items or accessories. Accordingly, it may be assumed that the term gear is to be broadly defined within the context of this disclosure. The expression 'gear holding member' is also to be broadly defined and includes any structure or construction which can be employed for engaging, holding, and or securing at least one piece of gear. The expression 'slidably movable', and the equivalents 'movably coupled', 'slidable and fixable coupling' and 'adjustably coupled', will be employed to describe a coupling of one or more gear holding members to a main portion (e.g., a main plate member). As will be seen, a slidable and fixable coupling arrangement, when employed, will enable an individual to place at least one gear holding member in one of a plurality of available and pre-defined positions, which may be termed 'fixing locations'. Once placed in a fixing location, a gear holding member is subsequently available to hold and secure gear. The expression 'support structure' is be assumed to include any permanent or temporary nearby structure that is engagable by the present invention for affixing to the structure (either temporarily or permanently). It should be noted that the most preferred embodiments of the invention are contemplated as being portable, such that they may be easily moved from one location to another. For example, embodiments may be structured to be used at a sporting event, such as a baseball game, wherein a hangable gear holder may be hung from a dugout or other fence/partition structure. Other important terms and definitions will be provided, as they are needed, to properly define the present invention and its associated novel characteristics and features. In addition, the terms and expressions employed herein have been selected in an attempt to provide a full and complete description of the invention. These terms may very well have equivalents known to skilled individuals, which may be long established in the art. As such, the chosen terminology is intended for illustration and completeness in description, and not for unduly limiting the scope of the invention.

Referring now to the drawings, FIG. 1 provides a high level generalized functional block diagram of a possibly most preferred embodiment of the present invention. As shown, a hangable gear holder 10 is depicted having a main portion 14, which may be preferably provided as a main plate member 14-1 (as seen in FIG. 1). Accordingly, the main portion 14 may most preferably be provided as a rigid item, and may be arranged having a first surface, a second surface, an upper edge, and a lower edge.

Figure 4:
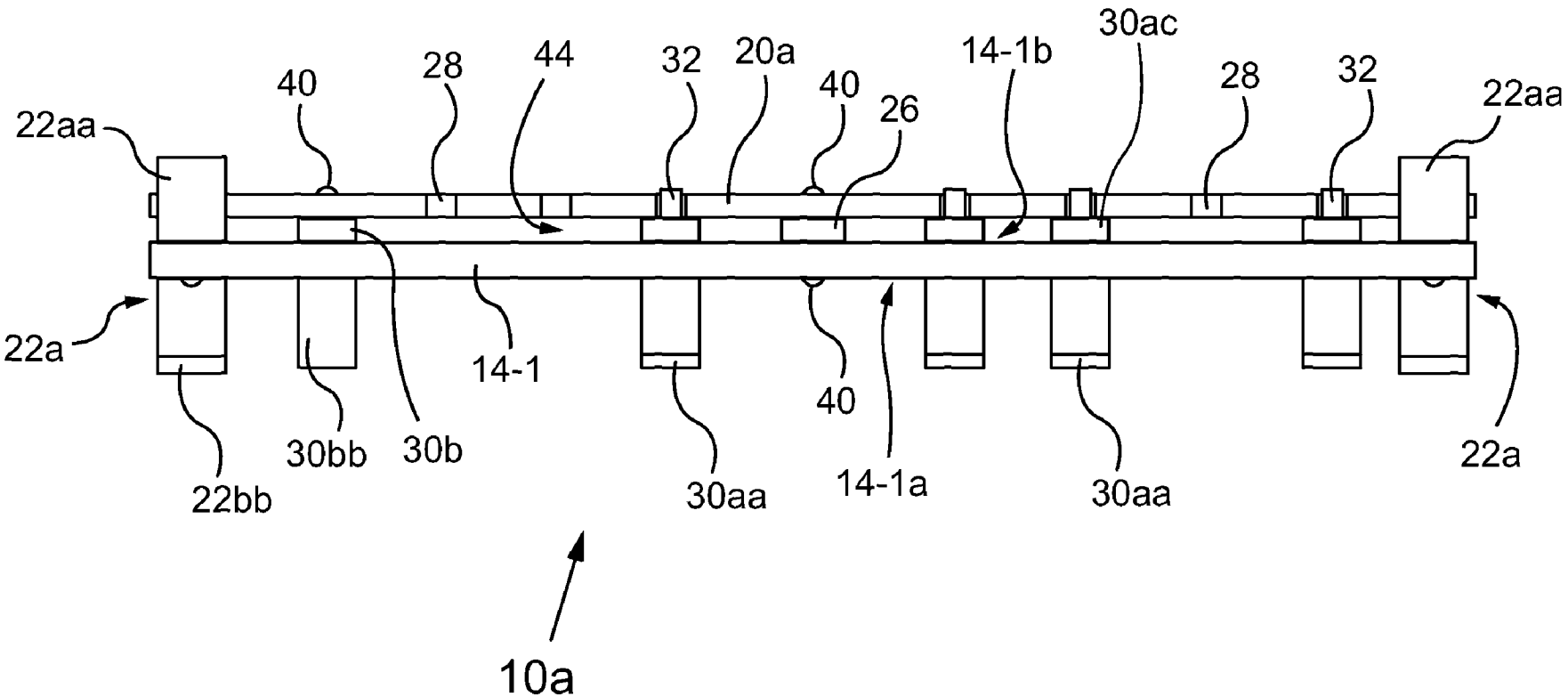
FIG. 4 provides a top view of the embodiment of the hangable gear holder of FIGS. 2 and 3A, and specifically taken along the line labeled 4 in FIG. 2.

Further depicted in FIG. 1 is a constrain arrangement. For example, as shown at least one elongated rail member 20 is spaced from the second surface 14*b* of the main portion 14 by way of a gap G. As such, included elongated rail members 20 (and equivalents thereto), in combination with other structures, including the second surface 14*b* of the main portion 14, may form at least one longitudinal slot 44 (as best seen in FIG. 4). The longitudinal slot(s) 44 may be included to support a slidable and fixable coupling, such as movable coupling 72 (CM) of a plurality of included gear holding members 30. Importantly, some gear holding members 30 may be provided with a movable coupling 72 (CM), and as a result may be moved and fixed within one of a number of available fixing locations, while other gear holding members 30 may be fixed via a fixed coupling 70 (CF). For example, fixed couplings 70 may be effected by employing items such as rivets, nuts & bolts, screws, etc. Examples of structures that support movable couplings 72 will be provided when referring to FIGS.

3A, 3B, 4, and 5. However, other related and equivalent structures may also be provided to yield this function.

Further included with preferred embodiments of the present invention, which may be portable embodiments, is at least one support structure engaging member 22. As shown in FIGS. 2 through 7, a most preferred arrangement would include a pair of support structure engaging members 22 in the form of s-shaped double hook members 22*a*. Importantly, included support structure engaging members 22 are structured for engaging a support structure (not explicitly illustrated) in order to make the present hangable gear holder available for use in holding and securing gear, as required. As understood by skilled persons, the configuration of a support structure engaging member may certainly vary. Indeed, a most preferred support structure engaging member may be best determined by the actual support structure with which a hangable gear holder 10 of the present invention is to be employed. For example, if the support structure is provided by a section of fence such as common chain-link or PVC fencing, then a curved and hook shaped support structure engaging hook portion 22*aa* may be preferable. It should therefore be understood that a support structure in accordance with the present invention may be any of a variety of structures ranging, for example, from quite porous items such as a chain link, to quite solid items such as solid walls and partitions. That said, an ideal support structure for the embodiments shown in FIGS. 2 through 7 would be an open or porous structure such as a common chain-link fence, or equivalents thereto.

Figure 2:
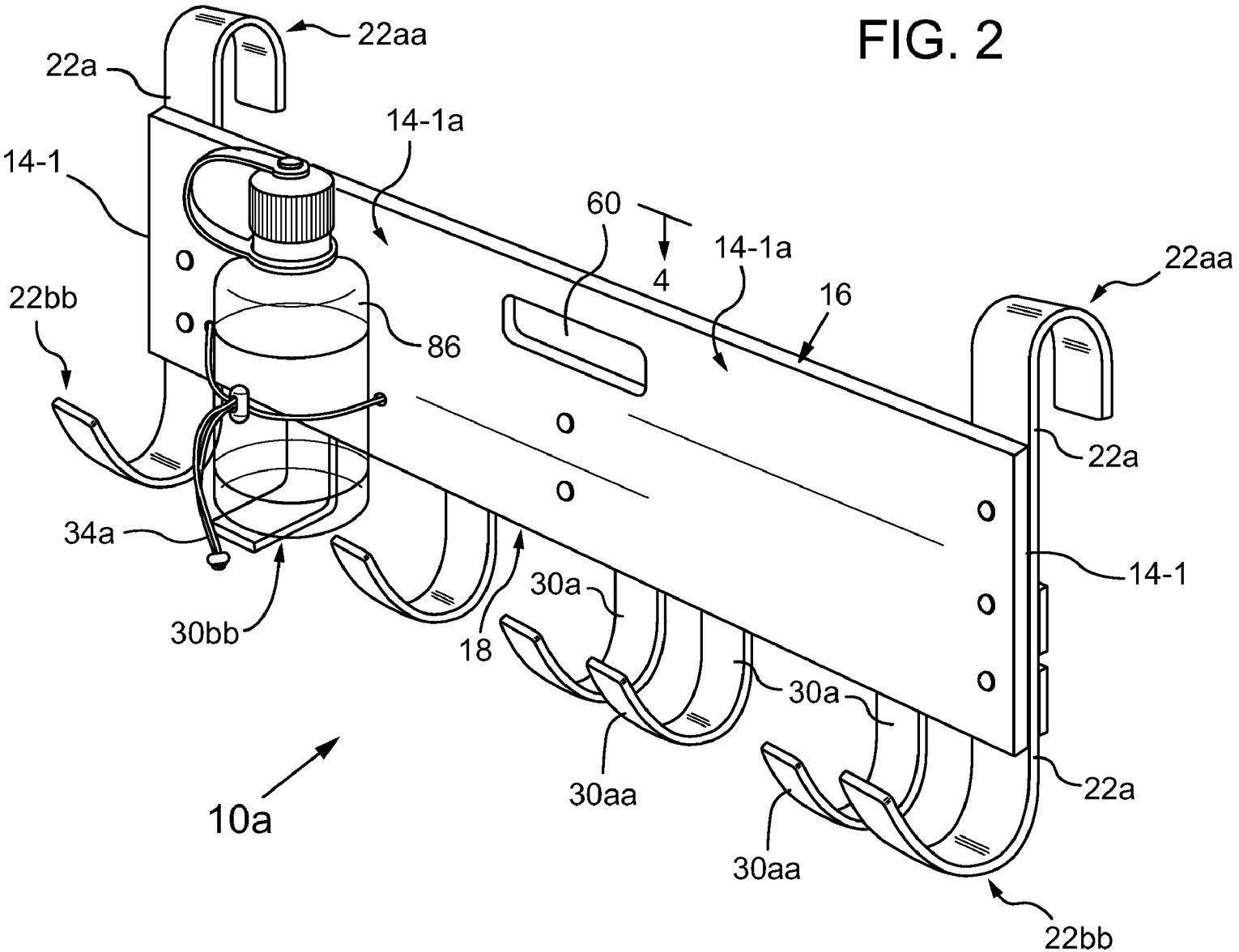
FIG. 2 provides an elevated perspective front view of a personal-sized structural embodiment of a portable and hangable sports gear holder of the invention.
Figure 3A:
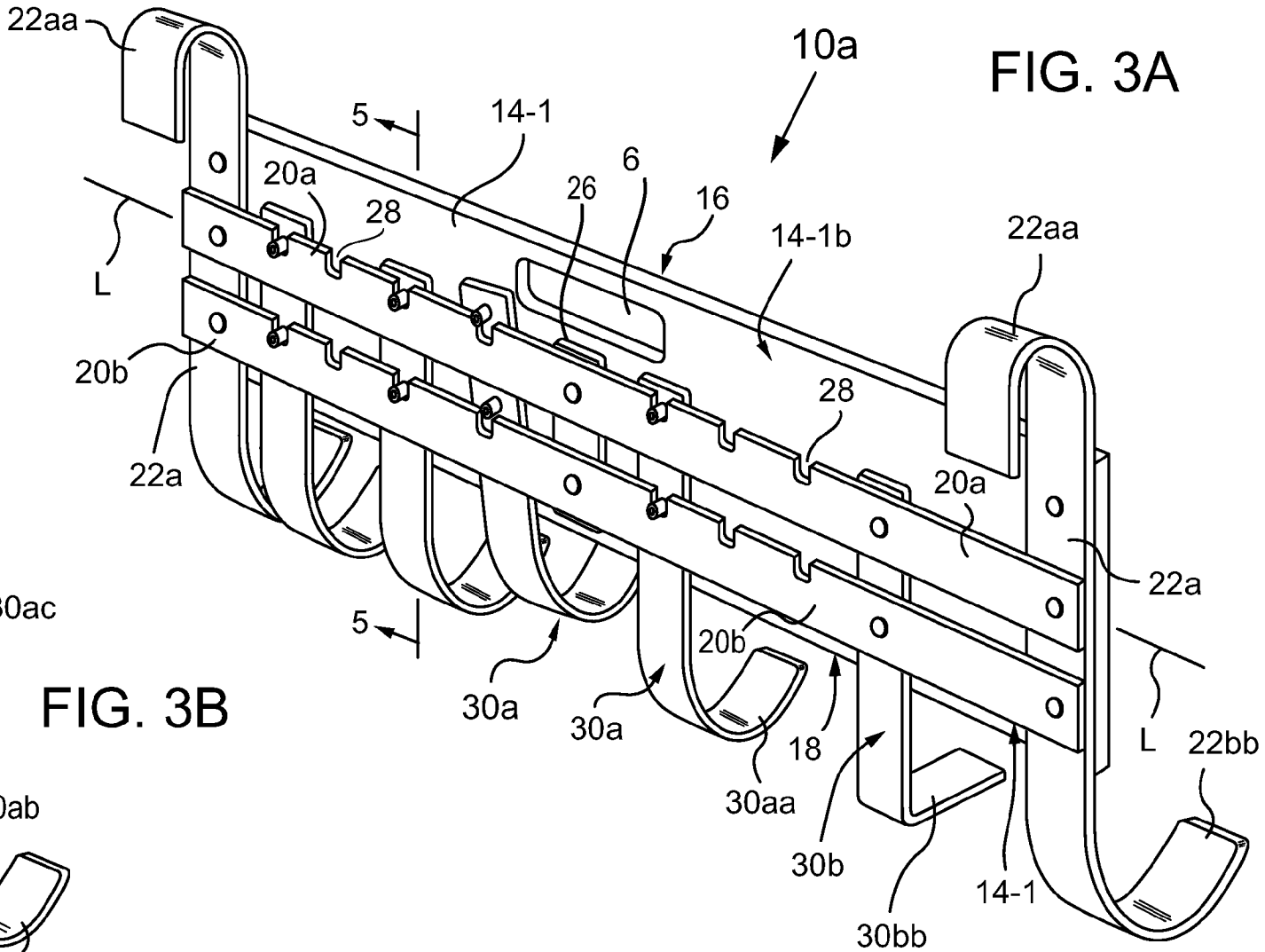
FIG. 3A depicts an elevated perspective rear view that is consistent with the embodiment of the gear holder depicted in FIG. 2.
Figure 3B:
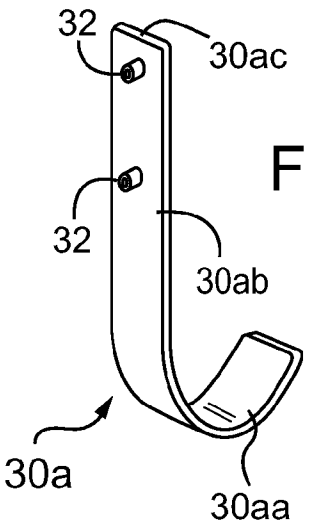
FIG. 3B provides a perspective view of one possible embodiment of a gear holding member, having a curved, upturned, hook shaped portion, that may be employed in a fixed or movably fixed configuration.

Turning now to FIGS. 2, 3A, and 3B, illustrated in an elevated perspective front view, and an elevated perspective rear view, respectively, is a personal-sized, portable, hangable sports gear holder 10*a* of the invention. As can be clearly seen, the embodiment 10*a* has a main portion 14 provided by a main plate member 14-1. The main plate member 14-1 may be provided as a substantially flat, rectangular plate or sheet material, and is preferably quite rigid. Further, a suitable main portion 14, such as main plate member 14-1, may have voids, holes and or cutouts. For example, at least one carry cutout 60 may be provided, as shown.

As clearly illustrated in FIGS. 2, 3A and 3B, and 4, a plurality of gear holding members 30 are included with preferable embodiments of the present invention. Importantly, gear holding members may be provided in a number of possible configurations, and include structures such as curved hook portions, outward and upward extension portions, orthogonally extended tabs, any of a variety of clip means, etc. For example, as depicted in FIGS. 2, 3A, and 3B, a movable hook member 30*a* may include an upturned, curved hook portion 30*aa*. The hook portion 30*aa* would be useful for engaging and holding (possibly in combination with other structures) at least one piece of gear. For the example embodiments depicted, the gear holding members such as 30*a* and 30*b*, are tailored for use with athletic and sports gear, and are shown located below a lower edge 18, and in front of a plane established by the first surface 14-1*a* of the main plate member 14-1.

Figure 6:
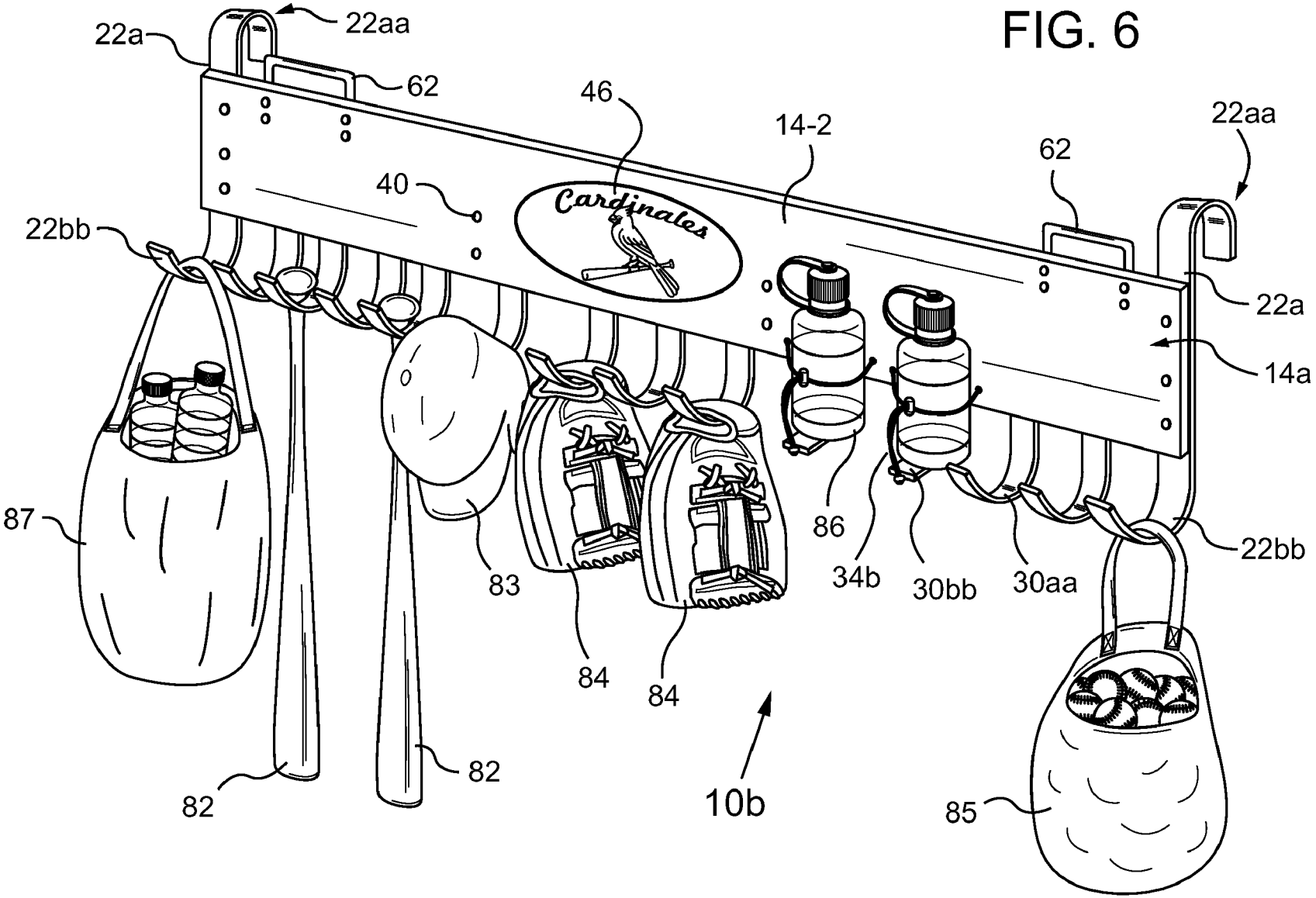
FIG. 6 provides an illustration of a larger possibly multi-player or 'teams' sized embodiment of a hangable sports gear holder in accordance with the present invention.
Figure 7:
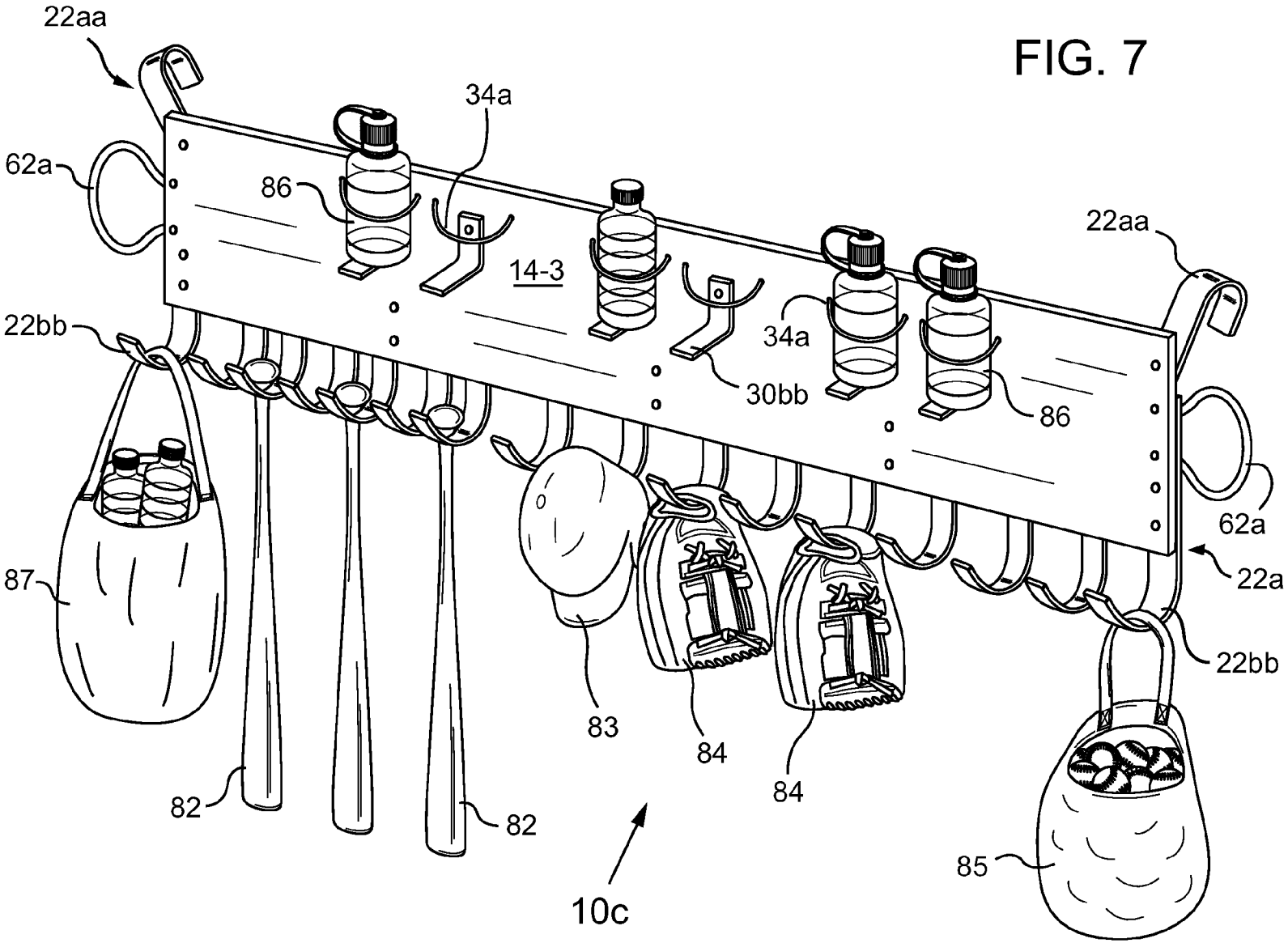
FIG. 7 depicts yet another possible structure of an embodiment of a hangable gear holder having a main portion, with a larger surface area, and a different configuration than found in other depicted embodiments.

Accordingly, the gear illustrated and being securely held may include, but is certainly not limited to, items such as baseball mitts, bats, gloves, caps, helmets, water bottles, balls, and the like. Additionally, as can be seen in FIGS. 6 and 7, two gear holding members in combination may be employed to, for example, engage and hold a baseball bat. It may also be noted that gear holding members, such as movable hook members 30*a*, may preferably be structured with a hook portion 30*aa*, and may also include a linear portion provided by a middle portion 30*ab* and an end portion 30*ac*. However, other configurations are certainly possible and contemplated as being within the scope of the invention.

Referring to FIGS. 3A and 4, and as discussed hereinabove, a preferred constraining arrangement may include elongated members 20, such as elongated rail members 20*a* and 20*b*. As shown, the elongated rail members 20*a* and 20*b* are spaced from the second surface 14-1*b* of the main plate member 14-1. This spacing is needed to provide for a means to constrain, and yet support a slidable and fixable structure for movable couplings, for use with a possible plurality of gear engaging structures, such as movable hook members 30*a* or bottom supporting tab members. In particular, the movable coupling arrangement, when employed, will enable an individual to lift and slide/move (see the middle of FIG. 3A) at least one gear holding member, such as hook member 30*a*, into an available pre-defined position. Again, each of these positions may be termed a 'fixing location'. Once in a fixing location, a gear holding member, such as movable hook member 30*a*, is subsequently available to hold and secure gear.

As clearly shown in FIG. 3A, each elongated rail member 20*a*/20*b* may be structured with a plurality of spaced notches 28 provided along an upper edge of each included elongated rail member. Importantly, the corresponding notches of each rail member 20*a*/20*b* are vertically aligned, and together define a fixing location. As such, as illustrated in FIG. 3A there are a total of 7 fixing locations available, as there are 7 pairs of vertically aligned notches provided by the two elongated rail member 20*a* and 20*b*. As appreciated by skilled individuals, the use of two elongated rail members, with one above the other, prevents a gear holding member from pivoting or rocking from side to side. That is, when a gear holding member is placed within a fixing location, side to side motion aligned with the longitudinal axis L (FIG. 3A) of the hangable gear holder 10*a*, is minimal or effectively prevented.

It may also be noted that when elongated rail members 20*a* and 20*b* are employed having the vertically aligned notches 28, the gear holding members 30*a* may be best structured having at least two vertically spaced notch engaging projections 32, which are preferably arranged proximate to the linear middle and end portions, 30*ab* and 30*ac*, respectively. For example, as shown in FIGS. 3A and 3B, the projections 32 are located upon the movable hook member 30*a* so as to drop down into the notches, placing the hook member 30*a* in a fixing location. As appreciated by skilled persons, a variety of structures may be employed to provide notch engaging projections in accordance with the invention. For example, such projections may be provided by threaded stubby studs. Alternately, suitable notch engaging projection may be smooth (versus threaded) press fit studs. Other simpler arrangements, such as employing a stamped projection formed by displacing and offsetting a localized portion of sheet material proximate to each of the middle portion 30*ab* and the end portion 30*ac*, may be most cost effective.

Figure 5:
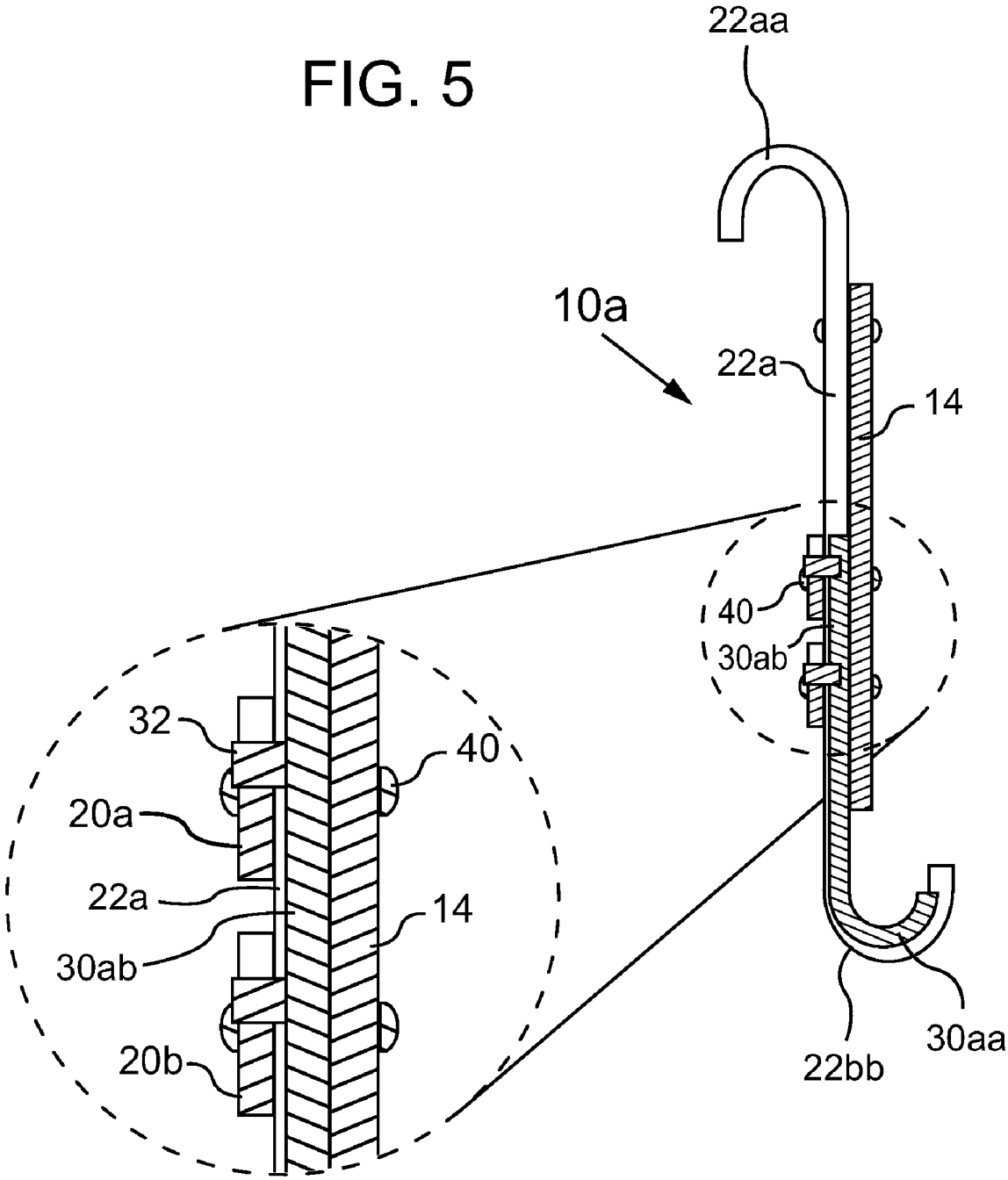
FIG. 5 illustrates a cross sectional view, taken along the line 5-5 of FIG. 3A, with FIG. 5 also providing an expanded view of a possible spacing arrangement.

Returning briefly to FIG. 4, and as also depicted in FIG. 5, spacers and spacing means are employed with preferable embodiments for securely and rigidly spacing the elongated rail members 20*a*/20*b* from the second surface 14-1*b* of the main plate member 14-1. Specifically, the spacers employed with the illustrated embodiments, which are just one of a number of possible embodiments, are provided in two forms. First the ends of the elongated rail members 20*a* and 20*b* are each spaced from the second surface 14-1*b* by the support structure engaging member 22 of the illustrated embodiments. Additionally, as required, block shaped spacers 26 may be employed. It may also be noted that spacers may be one piece or monolithic, or alternately composed of a number of thinner layers and may include shim members (not illustrated). For example, as best seen in FIG. 5, the s-shaped support structure engaging member 22*a* may be provided as having a thickness that is somewhat greater than the thickness of the middle portion 30*ab* and the end portion 30*ac* of a gear holding member 30. Alternately, if the support structure engaging member 22*a* and a movable hook member 30*a* are selected having the same thickness (not illustrated in FIG. 5), then shim layers may be employed, as needed.

Turning to FIGS. 6 and 7, alternate embodiments that are consistent with the embodiments of FIGS. 2 through 5, are illustrated. As shown, the hangable gear holders 10*b* and 10*c* are depicted with a plurality of baseball gear being engaged and held securely thereupon. The gear shown includes baseball mitts 84, bats 82, helmet 83, etc. Clearly the embodiments of FIG. 6 and FIG. 7 are larger, and if properly scaled, may be sized to support gear for several individuals, or possibly even an entire team. When this is the case, embodiments of the hangable gear holder 10*b* and 10*c* may be structured to hold heavier items such as a sack of water bottles 87 or a bag of baseballs 85. Accordingly, the main portion 14 as depicted may be provided as a longer structure 14-2 (as in FIG. 6) and or as a taller structure 14-3 (as in FIG. 7).

As shown in FIG. 2, and possibly best seen in FIGS. 6 and 7, embodiments of the invention may contain specialized gear holding members 30, such as bottom supporting tab member 30*b*. It may be noted that the depicted tab member 30*b* may be employed to support individual items such as drink containers (e.g., water bottles) and the like. As shown, the tab member 30*b* may be arranged having an orthogonally extended bottom tab 30*bb* and may be used in conjunction with a securing means, such as an elastic loop 34*a* and an adjustable loop 34*b*. The bottom tab 30*bb* may be located below a lower edge 18 of the main plate member 14-1, as shown in FIG. 2, but this need not always be the case (as shown in FIG. 7)

Returning to FIG. 6, another feature of the present invention is depicted. As shown, when the structure of the main portion provides adequate space, such as is the case with the main plate member 14-2, a graphic 46 may be provided. It is to be understood that the term 'graphic' is to include any decorative item, such as a logo, company or team symbol, and textual items such as names, numbers, etc. Certainly, such items may be included to personalize and or decorate the respective hangable gear holder 10 of the invention. Accordingly, the term graphic may be assumed to include at least one of a graphical or picture item, a text string (e.g., a series of letters, numbers, and or symbols), an etching, and an engraving.

While there have been described herein a plurality of the currently preferred embodiments of the means and methods of the present invention, those skilled in the art will recognize that other and further modifications may be made without departing from the invention. For example, when considering the structure of the main portion 14, embodiments such as FIG. 7 may be provided with a larger number of drink holding means, either slidably or fixedly coupled thereto. Alternately, a shelf structure may possibly be fixed to the main portion, possibly having cutouts to accept a drink container therein (not illustrated). In addition, in place of one or more carry cutouts 60, alternate carry means such as carry handles 62 and 62*a* may be included. Indeed the carry handles may be formed by extended end portions that are formed of the same preferably flattened and rigid sheet material as a suitable main portion 14 (i.e., main plate members 14-1, 14-2, or 14-3). In addition, support structure engaging members 22/22*a* may be provided by simpler structures and include an adjustment capability as depicted in FIG. 7. Importantly, when used with a support structure having openings for engaging included support structure engaging members 22*aa*, the shown swivel capability may be most helpful.

As such, the foregoing descriptions of the specific embodiments of the present invention have been provided for the purposes of illustration, description, and enablement. They are not intended to be exhaustive or to limit the invention to the specific forms disclosed and or illustrated. Obviously numerous modifications and alterations are possible in light of the above teachings, and it is fully intended to claim all modifications and variations that fall within the scope of the appended claims provided hereinafter.

What is claimed is:

1. A hangable gear holder, comprising:

a) a main portion having a first surface and a second surface, and an upper edge and a lower edge;

b) a plurality of movable gear holding members structured for engaging and holding at least one piece of gear, with each gear holding member comprised of an end portion, a middle portion, and a gear engaging end;

c) a constraining arrangement including at least one elongated rail member, said at least one elongated rail member spaced from the second surface of the main portion and fixed to the main portion at a plurality of pre-selected locations along a longitudinal axis of said at least one elongated rail member and the main portion; said at least one elongated rail member spaced and fixed so as to establish a longitudinal slot formed between the second surface of the main portion and a first surface of said at least one elongated rail member;

d) the longitudinal slot structured for slidably constraining the movable gear holding members, with the longitudinal slot formed so as to be aligned with a longitudinal axis of the main portion;

e) wherein the longitudinal slot is sized such that the end portion and the middle portion of each movable gear holding member, is capable of being slidably movable within the slot and mechanically lockable in one of a plurality of available fixing locations;

and at least two spaced s-shaped double hook members, with a first double hook member located at the first end of the main portion and a second double hook member located at the second end of the main portion, respectively, each double hook member comprised of a first hook support structure engaging hook portion for engaging a support structure, a second hook gear holding hook portion for engaging gear and a middle portion for spacing the at least one elongated member from the second surface of the main portion.

2. The hangable gear holder as recited in claim 1, wherein each gear holding member includes a middle portion that is substantially linear and structured with a gear engaging end comprising at least one of:

a) a curved end portion forming an upturned hook; and b) a tab portion extending substantially orthogonally to the longitudinal axis of said at least one elongated rail member as well as orthogonally to the first surface of the main portion;

c) wherein each included curved end portion and tab portion, when in a fixed position for use are, located below a lower edge, and in front of a plane of the first surface of the main portion.

3. The hangable gear holder as recited in claim 2 comprising at least two elongated rail members, wherein a plurality of spaced notches are provided along an upper edge of each elongated rail member, with corresponding notches of each rail member vertically aligned for providing the fixing locations for supporting and fixing the location of a gear holding member at one of the fixing locations, with the fixing being in a substantially vertical orientation.

4. The hangable gear holder as recited in claim 3, wherein the end portion and the middle portion of each gear holding member are each structured with a notch engaging projection arranged for dropping into and occupying vertically aligned notches of the at least two elongated rail members, fixing a respective gear holding member at a selected fixing location; wherein said elongated rail members are parallel.

5. The hangable gear holder as recited in claim 4, wherein each notch engaging projection is provided by one of:

a) a threaded stud that is screwed into the end portion and middle portion;

b) a press fit stud that is pressed into a pre-formed hole proximate to one of the end portion and the middle portion; and c) a stamped projection formed by displacing and offsetting a localized portion of material substantially proximate to each of the end portion and the middle portion.

6. A portable and hangable gear holder deployable at a location for use in engaging and holding gear, the hangable gear holder comprising:

a) a rigid main plate member, with the main plate member structured having a substantially elongated rectangular and flattened shape with a first surface and a second surface, an upper edge and a lower edge;

b) a plurality of gear holding members included for engaging and holding at least one piece of gear, with each gear holding member comprised of an end portion, coupled to a substantially straight middle portion, which is coupled to a gear engaging end, wherein the end portion and at least part of the middle portion of each gear holding member are substantially positioned adjacent to the second surface of the main plate member, while the gear engaging end is positioned below the lower edge of the main plate member and extending outwardly forward of the first surface thereof;

c) two substantially parallel elongated rail members positioned with a first elongated rail member placed above a second lower elongated rail member, and with each elongated rail member additionally substantially equally spaced from the second surface of the main plate member and fixed to the main plate member substantially aligned with and parallel to a longitudinal axis of the main plate member, such that at least one longitudinal slot is formed between the second surface of the main plate member and a first surface of each elongated rail member, and available for accepting and constraining therein the straight middle portion and end portion of each gear holding member, while further supporting a slidably coupled arrangement wherein gear holding members are movable from one fixing location to a second, adjacent, and available fixing location;

d) with each elongated rail member further structured having a plurality of notches formed in an upper edge at spaced locations along a longitudinal axis of the elongated rail members, with corresponding vertically aligned notches of each elongated rail member establishing the fixing locations for fixing the gear holding member in a substantially vertical orientation when positioned in one of a plurality of fixing locations;

e) wherein proximate to each of the end portion and the middle portion of each gear holding member a pair of notch engaging projections are structured for dropping into, occupying, and engaging vertically aligned notches of each fixing location, fixing a respective gear holding member in the fixing location so that the gear holding member can be utilized for subsequently engaging and supporting gear;

f) at least one support structure engaging member fixed to the main plate member and structured for engaging a proximate support structure in order to hang the hangable gear holder.

7. The portable and hangable gear holder as recited in claim 6, wherein each elongated member is spaced from the main plate member by a plurality of spacers.

8. The portable and hangable gear holder as recited in claim 7, wherein the plurality of spacers include at least two spaced s-shaped double hook members, with a support structure engaging hook portion of each double hook member being the support structure engaging member, and a gear holding hook portion of each double hook member is structured for engaging gear.

9. The portable and hangable gear holder as recited in claim 6, wherein each gear holding member is a flattened strip member having a thickness approximately equal to a thickness of the slot provided between the main plate member and the elongated rail member.

10. The portable and hangable gear holder as recited in claim 9, wherein each gear engaging end is provided as one of:

a) a curved end portion having an upturned hook portion; and b) an extended bottom tab extending substantially orthogonally to the longitudinal axis of each of the elongated rail members as well as orthogonally to the first surface of the main plate member.

11. The portable and hangable gear holder as recited in claim 10, wherein when a gear holding member is provided with a gear engaging end in the form of the extended bottom tab the gear holder further includes, an elastic loop member to aid in supporting an item placed upon the extended tab.

12. The portable and hangable gear holder as recited in claim 11, wherein the item that the extended bottom tab and elastic loop member are structured to support is a water bottle.

13. The portable and hangable gear holder as recited in claim 11, wherein each elastic loop member is passed through two holes provided in the main plate member, on either side of the fixing location wherein a gear holding member may be fixed.

14. The portable and hangable gear holder as recited in claim 6, wherein the main plate member is structured with the first surface capable of accepting and displaying a graphic.

15. The portable and hangable gear holder as recited in claim 6, further including carrying aides provided by at least one of:

a) carry handles fixed to the main plate member; and b) carry cutouts provided as one or more cutouts formed in the main plate member.

* * * * *